United States Patent [19]

McCormack

[11] Patent Number: 4,781,372

[45] Date of Patent: Nov. 1, 1988

[54] ICE-SKATING EXERCISE DEVICE

[76] Inventor: Patrick J. McCormack, 56 N. Truro St., Hull, Mass. 02045

[21] Appl. No.: 38,871

[22] Filed: Apr. 15, 1987

[51] Int. Cl.[4] ..... A63B 23/04

[52] U.S. Cl. ..... 272/70; 272/118; 272/97

[58] Field of Search ..... 272/70, 93, 117, 118, 272/130, 134, 97, 96; 128/25 B, 25 R

[56] References Cited

U.S. PATENT DOCUMENTS

| | | | |
|---|---|---|---|
| 3,627,315 | 12/1971 | Marcyan | 272/118 |
| 3,756,595 | 9/1973 | Hague | 272/70 |
| 3,834,693 | 9/1974 | Poppenberger | 272/97 |
| 4,340,214 | 7/1982 | Schutzer | 272/70 |
| 4,601,464 | 7/1986 | Mousel | 272/73 |

FOREIGN PATENT DOCUMENTS

| | | | |
|---|---|---|---|
| 689687 | 10/1979 | U.S.S.R. | 272/70 |

*Primary Examiner*—Richard J. Apley
*Assistant Examiner*—J. Welsh
*Attorney, Agent, or Firm*—William Nitkin

[57] ABSTRACT

An ice-skating leg exercise device utilizing in one embodiment a pair of rotatably positionable tracks each having a stirrup movable back and forth thereon in which the user's legs are positioned, each track being angularly adjustable with adjustable weight resistance provided against the rearward movement of each stirrup and a body support for the user to rest thereagainst while exercising his legs on the device.

10 Claims, 5 Drawing Sheets

ICE-SKATING EXERCISE DEVICE

BACKGROUND OF THE INVENTION

1. Field of the Invention

The device of this invention resides in the field of exercise apparatus and more particularly relates to an apparatus that allows the user to simulate skating movements for leg exercise.

2. Description of the Prior Art

It has long been recognized that training and exercise activities that are specific to the sport that one wishes to engage in are beneficial and that such exercises can develop improved strength and agility in the actual groups of muscles used when playing the particular sport. When one exercises for a specific sport, one not only gains in strength and endurance but one also increases his skills in performing that sport. Exercises embodying progressive resistance to muscle movement which resistance is increased systematically as the body adapts to the training stimulus increase the strength of the muscle groups being exercised. It has been found that exercising muscles at the specific angle that they will be utilized in a particular sport significantly improves one's skill in that sport. Therefore in order to increase their skill, strength and endurance in a particular sport, athletes will frequently engage in exercises that mobilize specific muscle groups at the specific angles that such muscle groups would be used in such sport.

SUMMARY OF THE INVENTION

It is an object of this invention to provide an exercise apparatus to be utilized when one is exercising specifically for the sports of ice-skating, speed skating, cross-country skiing and ice hockey. The exercises to the legs provided by the use of the apparatus of this invention duplicate the movements one performs when skating which movements are unique to that activity. Other traditional exercises and exercise machines fail to utilize the specific groups of muscles at the specific joint angle that are utilized in the particular movements of hockey. The device of this invention can be used not only in exercise programs to improve a skater's strength and skill but also for rehabilitating an injured skater. Usage of the apparatus of this invention can also help determine whether an injured skater has regained sufficient strength and stamina to re-engage in the sport. Further, the regular use of the device of this invention will help to maintain a skater's muscle strength and endurance both during the hockey season and the off-season when a skater cannot regularly engage in the sport.

It is a further object of this invention to allow for specific selected muscle groups to be exercised at the specific joint angles to increase the user's strength in those muscle groups. The device of this invention eliminates the glide phase in skating. The device of this invention controls the work load on the user's legs during exercises and the continuous leg movements performed when using this apparatus stimulate muscle growth and increases strength.

It is yet a further object of this invention to provide a controlled environment for evaluation of a player's abilities.

The device consists of a base plate which rests upon the ground which base plate has in one embodiment two track attachment members. A pair of tracks are attached to the attachment members in a way to allow for rotational adjustment of the position of each track from each of the track attachment members. Stirrups for the attachment of one's foot are provided each of which stirrups can move backwards and forwards in sliding relationship within a channel defined in each track. A balance pad is provided on an upright in front of the user upon which the user rests his chest. Hand rests can also be provided for the user to grasp. When the user's feet are attached to the stirrups in each track, the tracks having been placed at the desired angled position, the user can engage in a skating motion with his legs. The skating motion is duplicated because each stirrup allows for lateral rotation thereof with adjustable resistance to such rotation and a limited range of movement forward and rearward as will be discussed in detail below. A weight system provides different resistances to the rearward movement of the stirrups so that the skater can engage in action that duplicates the action of skating except he does it in repetitive movement rather than having glide movements in between each leg movement. The tracks are movable to a plurality of angles from 0 to 180 degrees from the base plate. In instances where it is desired that only one leg be exercised, only one track could be utilized for movement while the other track would have a stirrup that is fixed in position but can be medially and laterally rotated by the user's foot so that the user could exercise only one leg while the other leg would be used for support.

It is a still further object of this invention that the user be able to engage in a large variety of skating movements which duplicate essentially all of the movements that a skater might engage in at a hockey rink especially the angular and side-to-side leg movements used in hockey play. For example, the tracks could be moved from a position parallel to the direction the user is facing to a position that is perpendicular to the direction of the user so that the user's legs would be moving laterally side-to-side for lateral exercise. This type of lateral exercise would be difficult on any other kind of exercise device. It should be noted that the device not only allows for forward and backward leg movements but also for angular leg movement when the tracks are adjusted to various angles. It is the variety of angular movements available on the device of this invention that produces the similarity to actual ice-skating and ice hockey movements.

DESCRIPTION OF THE PREFERRED EMBODIMENT(S)

Figure 1:
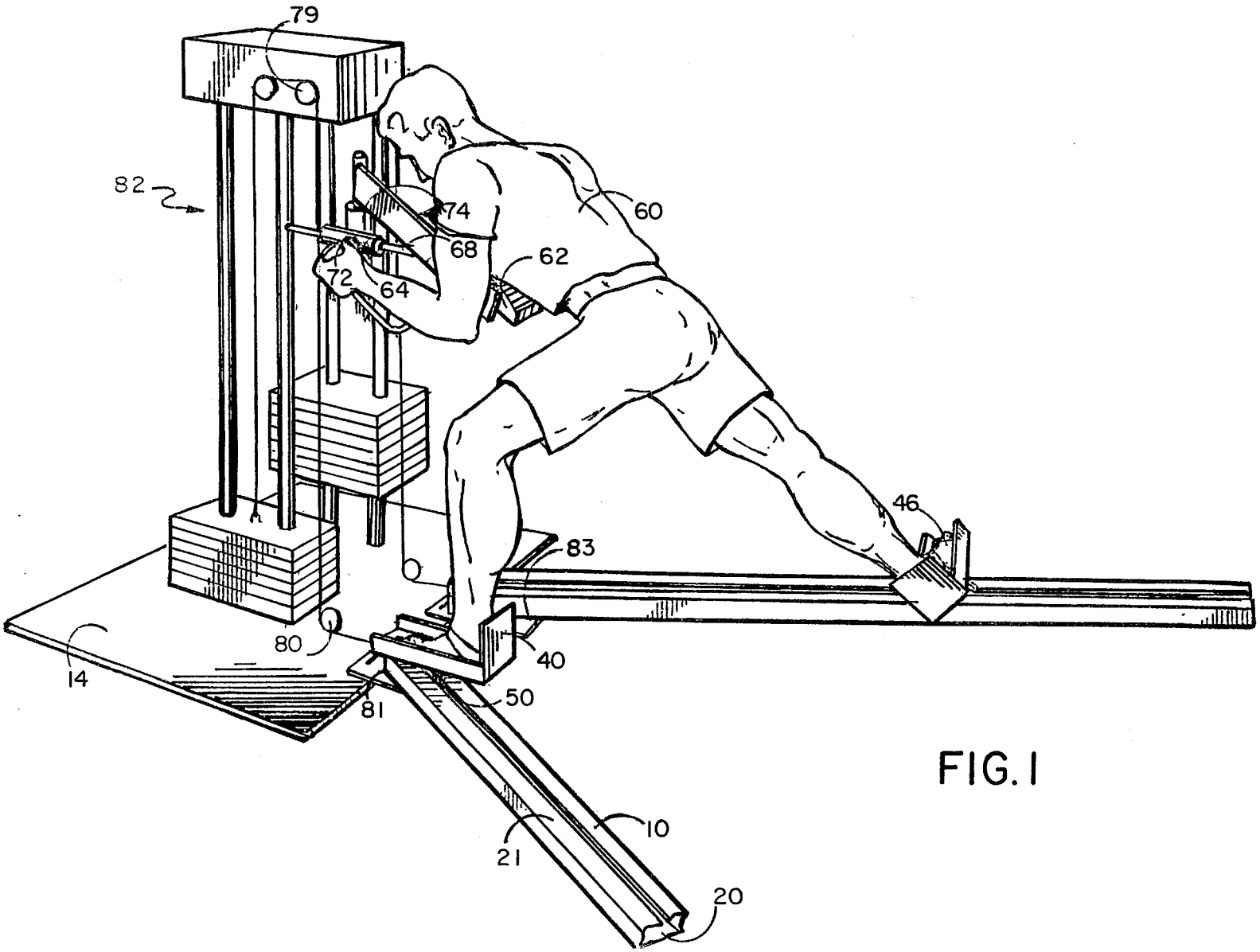
FIG. 1 illustrates a perspective view of the device of this invention in use.
Figure 2:
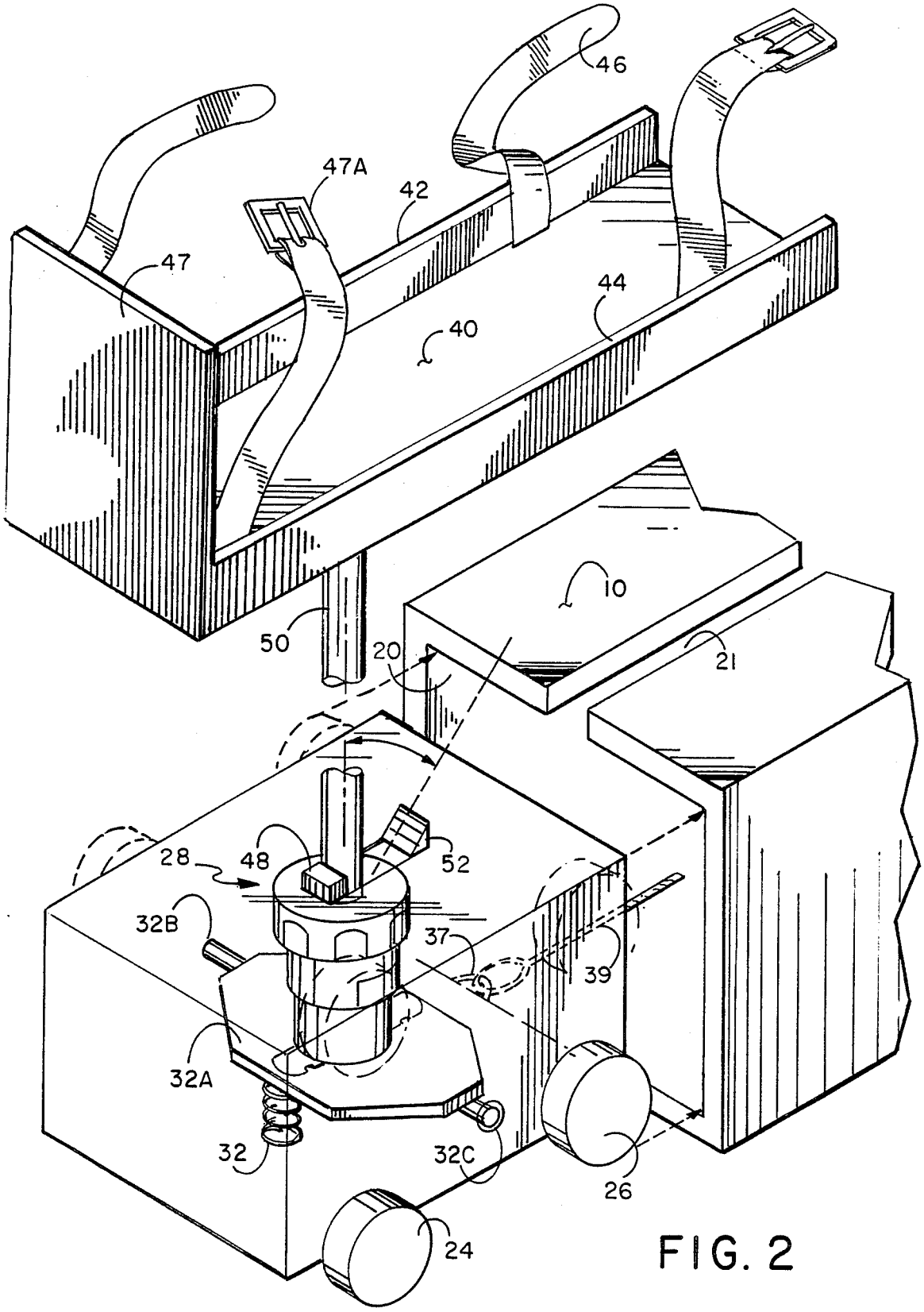
FIG. 2 illustrates a view of the stirrup structure moved out of the channel of the track.
Figure 5:
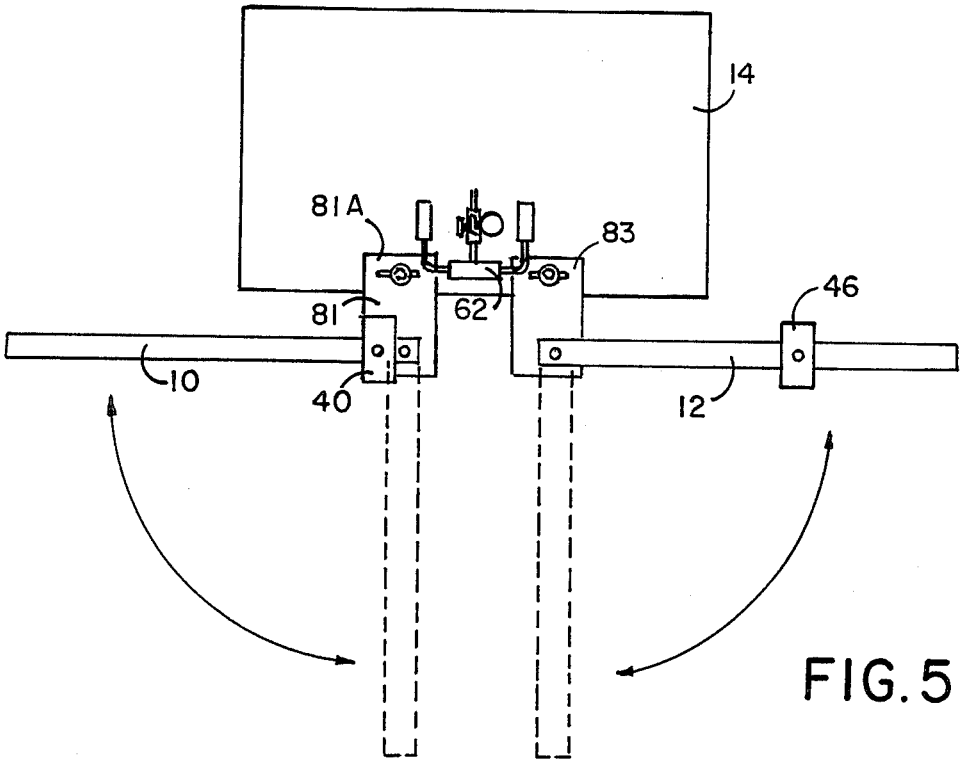
FIG. 5 illustrates a top view of the base plate with the tracks adjusted for side-to-side exercises.
Figure 6:
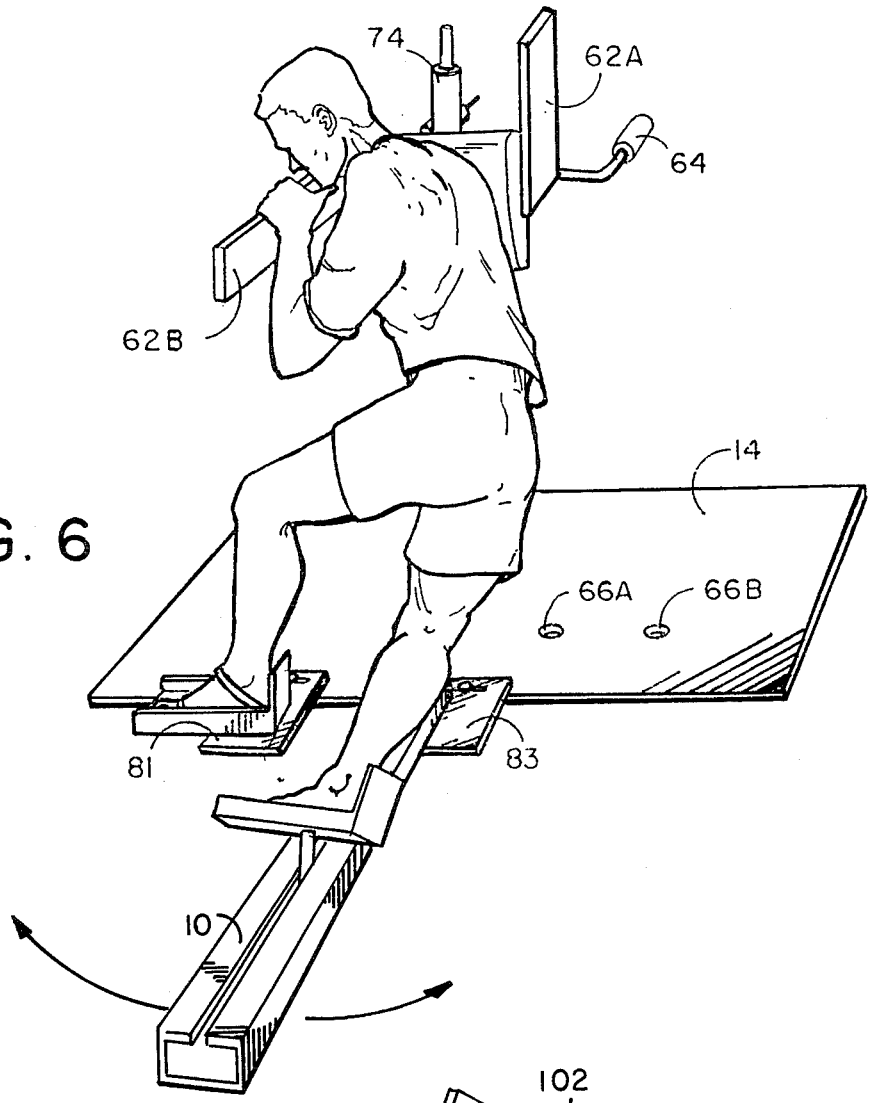
FIG. 6 illustrates a perspective view of the user exercising with a single track.

FIG. 1 illustrates the exercise apparatus of this invention in use. Basically the device has a pair of tracks 10 and 12 which are attached to base plate 14 at track adjustment plates 81 and 83. The track adjustment plates are adjustably attached to the base plate and are substantially planar members resting on the floor. Track adjustment plates 81 and 83 can be repositioned laterally to vary the distance therebetween to adjust the distance between the tracks. The tracks are movably attached each respectively to one of said track attachment plates so that the tracks can when desired be independently rotated laterally from a point where they are extending substantially straight back and forth from the direction of the base plate toward which the user often faces to positions where they are substantially perpendicular such as seen in FIG. 5 to the direction in which the user is facing for lateral sideway exercise movements and to all positions in between. In some embodiments there might only be one track as seen in FIG. 6 which will be discussed in further detail below. Within each track is defined a channel 20. In FIG. 2 stirrup 40 is seen attached by shaft 50 to guide member 22 which can be moved back and forth within channel 20 with shaft 50 passing through slot 21 defined in the top of each track.

In operation, the user leans his chest on balance pad 62 as seen in FIG. 1 and moves his feet back and forth while they are attached to stirrups 40, and the attached guide members 22 move back and forth within channel 20, allowing the user to duplicate the leg movements of ice-skating. Guide member 22 is seen in further detail in FIG. 2 where track 10 can be seen in sectional view having a channel 20 therein with slot 21 thereabove. Stirrup 40 can have sides 42 and 44 on either side thereof sufficiently placed apart from one another to enclose the user's foot therebetween. Heel plate 47 can be positioned at the end of stirrup 40. Straps 46 and 47*a* help retain the user's foot in the stirrup which retention is helpful when the user moves his leg forward to prevent one's foot from leaving stirrup 40. Because shaft 50 must have limited rearward movement, rear stop 48 is provided which can be a solid piece of metal shaped so that the shaft will not move rearward from an upright position. It is important that the shaft not move rearward to avoid injury to the user since such movement would be an unnatural movement for his foot. Shaft 50 must move forward though to accommodate the natural foot positioning, and front stop 52 is provided cut at an angle so that shaft 50 can move forward to a point where it contacts front stop 52. Lateral movement of stirrup 40 also rotates shaft 50. Within guide member 22 is a rotation resistance device 28 which provides adjustable resistance to easy rotation of shaft 50 thereby causing stirrup 40 to rotate slowly under pressure. Such adjustable hydraulic rotation resistance devices are well known in the art such as oar resistance mechanisms in rowing machines as found in, for example, the MCA Sport Model 2010 rowing device. Such rotation resistance device has significant resistance to one-way rotation and somewhat lesser resistance to a rotation back to its original starting point. With these medial and lateral rotational and forward and rearward angular movements of shaft 50, the foot stirrup will accommodate the natural movements of an ice skater. Guide member 22 contains rotation resistance device 28 within framework 30 which has ball bearings or wheel members such as wheels 24 and 26 and others not numbered which allow it to move freely back and forth within channel 20. Rotation resistance device 28 is mounted on plate 32*a* to allow the stirrup to move back and forth between rear stop 48 and front stop 52. Plate 32*a* is supported on shafts 32*b* and 32*c* which extend into apertures defined in the sides of framework 30 and can rotate back and forth. Spring 32 extending from the bottom of framework 30 puts pressure on plate 32*a* to provide resistance to such back and forth movement. In an alternate embodiment the guide member can have a pair of wheels mounted at its front and back, such wheels being of the size of the channel and adapted to roll therein. Such an embodiment might not have a movable stirrup but could have a fixed stirrup mounted on a shaft extending through the channel to the guide member. Such a fixed stirrup alternative is shown in FIG. 7 discussed below.

Figure 7:
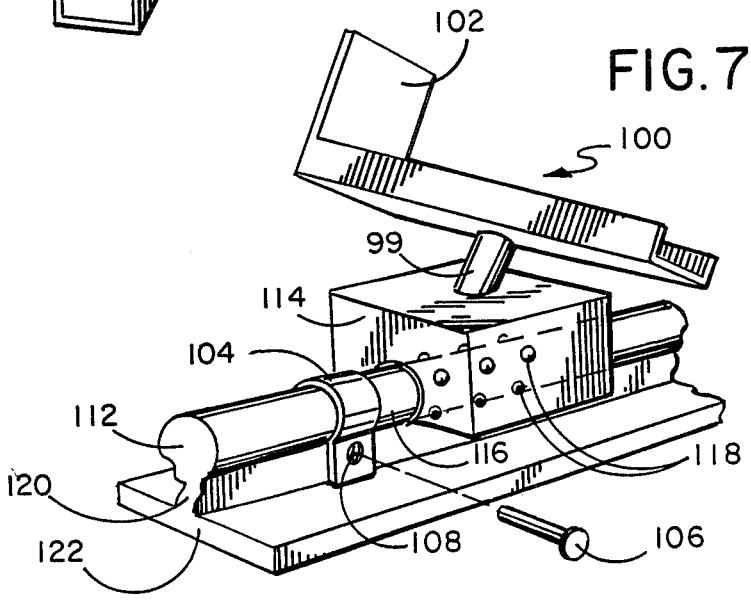
FIG. 7 illustrates an alternate stirrup and track construction.

FIG. 7 illustrates an embodiment of an alternate track and of a fixed stirrup without such stirrup having the forward, backward or rotational motions of the embodiment of FIG. 2. In some instances it would be desirable that this embodiment be locked into position on the track. This fixed stirrup can be attached by support member 99 to guide member 114 which has an opening 116 defined therein. This alternate track has a body 112 held up by a narrower body support 120 on base 122. Opening 116 in guide member 114 fits around track body 112 and moves back and forth thereon in a slideable relation Ball bearings 118 can help reduce friction between guide member 114 and track body 112 as thye are placed around the inside of aperture 114 contacting track body 112. Fixed support member 99 can extend from guide member 114 to hold stirrup 100 at a preset angle on top thereof. It should be noted that even though this track embodiment is shown with a fixed stirrup, that movable stirrups could also be used thereon. Stirrup 100 has a back plate 102 thereon. In this view stirrup 100 is fixed tilted at an angle and perpendicular to the direction of the track. It should be noted that other fixed positions could be utilized. This stirrup can be held in place and prevented from movement along the track as could other stirrup embodiments by means of clip 104 which can be affixed over track body 112 in front of the guide member or support member, and pin 106 can be placed through aperture 108 in the sides of clip 104 to pass through an aperture in body support 120 to prevent movement further along the track of the stirrup. Other equivalent locking mechanisms could be used to fix the stirrups in any desired position on the tracks when needed for a particular exercise. This feature is helpful when doing warm-up and twisting exercises.

At the front of guide member 22 in FIG. 2 is attachment ring 37 for a cable or chain 39 to be attached which cable 39 extends from a movement resistance means. This movement resistance means could in some cases be a spring member or rubber strap which may be adjustable in tension to cause resistance to rearward movement of stirrup 40 but as illustrated in FIG. 1 in one embodiment, cable 30 extends around first pulley 80 and then upwards around second pulley 79 and down to weight system 82 where a series of weights moving on weight guides can be attached or disengaged depending upon the amount of weight resistance desired. A separate independent weight system can be provided for each track so that more weights can be lifted with each leg movement if one wished more resistance to the rearward movement of stirrup 40 in the track. Such weight systems are well known in the art for applying variable resistance to force, and it is important to note that many types of adjustable weight resistance systems could be applied to the rearward movement of the stirrup within the track which would suffice for usage in the device of this invention.

Figure 3:
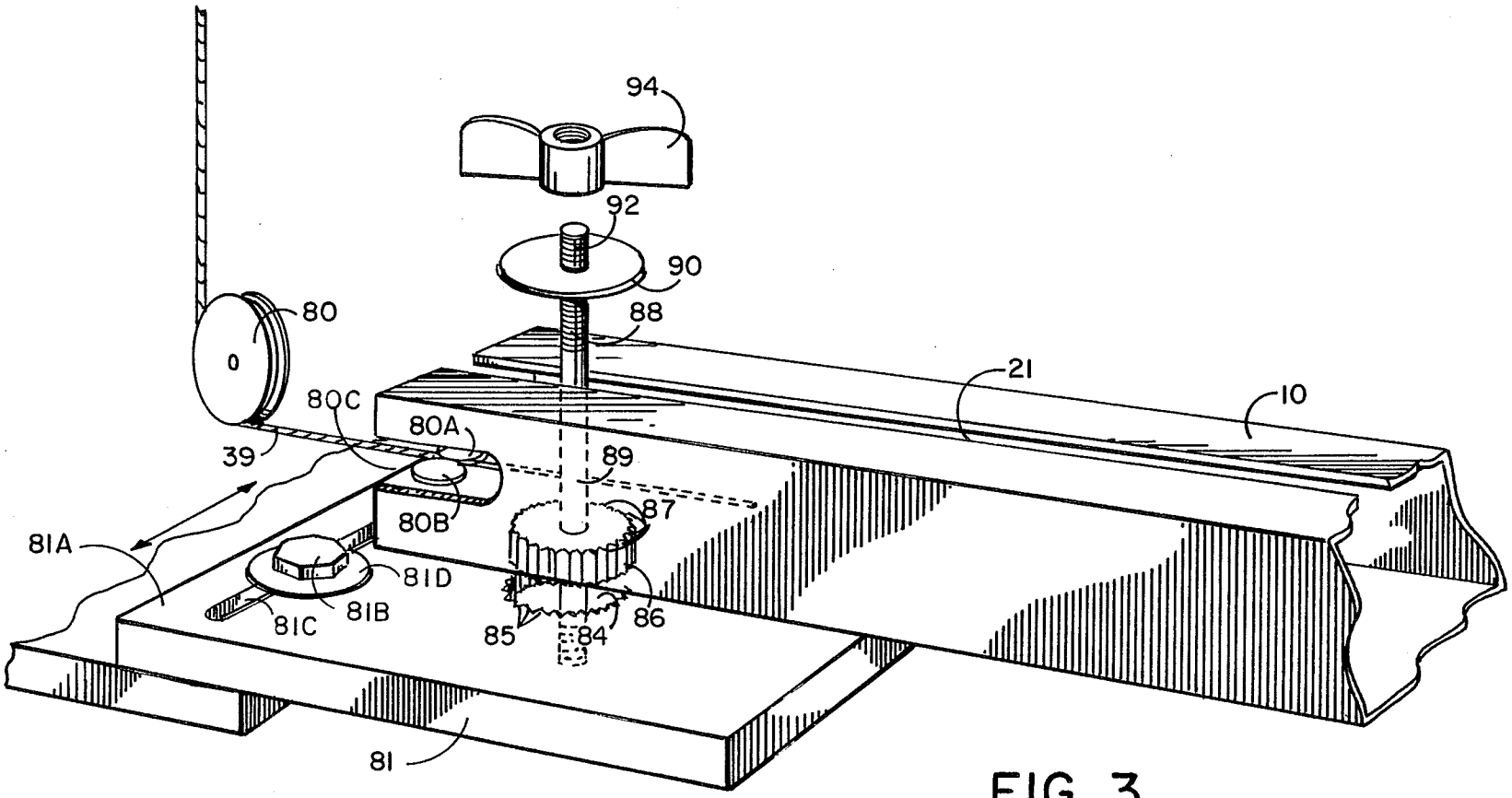
FIG. 3 illustrates the track adjustment means by which the tracks can be adjusted to various angles from the base plate.

As seen in FIG. 3 the lateral movement of the left and right track is critical to the usage of the device to allow duplication of the many different angles of leg movement used in skating. An attachment plate aperture 84 with a plurality of teeth 85 extending therearound is defined in each track attachment plate. Aperture 89 can be formed at the bottom of the front of track 10 to receive therethrough shaft 88 affixed to the bottom of track adjustment plate 81. Affixed on the bottom of track 10 is adjustment wheel 86 which has a plurality of teeth 87 disposed around its perimeter. Adjustment wheel 86 has an aperture 93 at the center thereof which is aligned with aperture 89 in track 10 through which shaft 88 is passed. Adjustment wheel 86 is adapted to engage into attachment plate aperture 84 with teeth 85 locking into and meshing with teeth 87 at a plurality of positions thereby making the variable angular positioning of each track adjustable by lifting and resetting the track at a new angle with the teeth 85 and 87 then meshing at a different track angle position. The teeth prevent rotational movement of the track once they are meshed. Shaft 88 extends through aperture 89 in track 10 and aperture 93 in adjustment wheel 86 and shaft 88 then protrudes out through slot 21 to a point above track 10. Track 10 is held on shaft 88 by washer 90 and nut 94 screwed onto the threaded end of shaft 88. To change the angle one can loosen nut 94 and lift the track and its attached adjustment wheel 86 and rotate the shaft to a new angular position, repositioning teeth 87 to mesh with teeth 85 at such other position rotated from the first position to then be at the angle desired and to reapply nut 94 over washer 90 to hold track 10 in place. In this way the tracks can be adjusted at any angle from 0 to 180 degrees from the base plate on the track attachment plates.

In some instances one may wish to have the tracks extend laterally as seen in FIG. 5 to the forward-facing user for side-to-side exercises and this can be accomplished with the device of this invention by so adjusting the above-described track angle adjustment means. FIG. 5 illustrates a top view of such configuration and also shows the lateral adjustment means of plates 81 and 83. In this view and in FIG. 3 slots **81*c* are seen in plate adjustment member 81*a* through which bolt 81*b* with washer 81*d* extends and is tightened into base plate 14. To lateally move either plate, one loosens bolt 81*b* and plate 81*a* is slid sideways with slot 81*c* moving around blot 81*b* until plate 81*a* is at the desired position where bolt 81*b* is retightened. In FIG. 3 cable 39 extends out the end of track 10 to pass around pulley 80. To assist in easy movement of cable 39 to prevent it from binding on the end of track 10 when placed at various angular positionings, side-by-side horizontally arrayed pulleys 80*a* and 80*b* can be used for cable 39 to pass therebetween which will center cable 39 as it leaves the end of track 10. Also slot 80*c* can be cut out of each side of track 10 at its end to allow passage of cable 39 therethrough when the track is rotated laterally as seen in FIG. 5. When using the device of this invention, the user 60** must have his feet attached to the stirrups.

In some embodiments only one track is used, and the second track is removed with its adjustment plate fitted with a stationary stirrup so that one leg can be exercised at a time while the stationary stirrup helps support the user's body. Such an embodiment is seen in FIG. 6 where the user is exercising his right leg to simulate the cross-over stride in skating. The single track could also be adjusted to a variety of angles.

Figure 4:
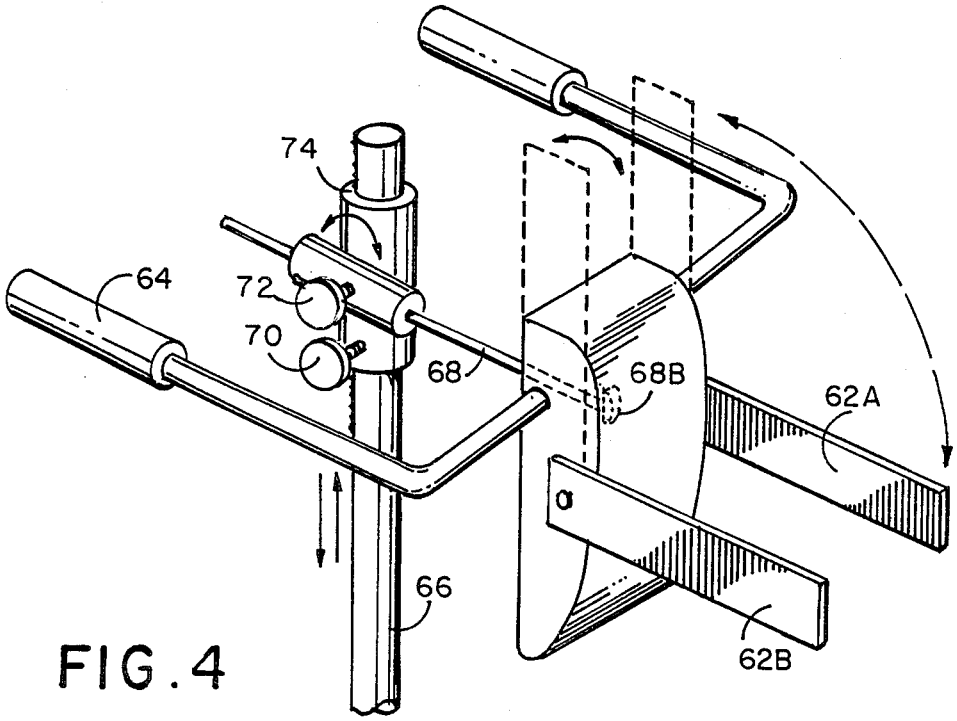
FIG. 4 illustrates the body support pad with side wings and its adjustment members.

For body support when the device is in use, balance pad 62 illustrated in FIG. 4 is provided upon which the user rests his upper body. Balance pad 62 is adjustably mounted on pad support beam 66 which extends upwards from its mounting on base plate 14. Hand rests 64 can be attached to balance pad 62 for the positioning of the user's hands. Balance pad vertical adjustment 70 can be provided which can be a geared member adjustably engaged to support beam 66 and which through a geared wheel can be adjusted up or down thereon. Forward and backward positioning of balance pad 62 can be accomplished by member 72 which allows for tightening against laterally movable shaft 68 to hold shaft 68 in place once its position has been set so that the balance pad can be adjusted to a variety of positions for use by individuals of different sizes. Pad 62 can also be adjusted by a ball and socket attachment **68*b* to shaft 68. In some exercises the user's side would be against pad 62 and side wing members 62*a* and 62*b* can be provided to grasp onto or lean against. Wing members 62*a* and 62*b* can be rotatably attached to the sides of pad 62 to be moved out of the way when not needed. In some exercises, expecially when only one track is used, the pad support beam 66 can be moved to a different mounting hole such as 66*a* and 66*b* as seen in FIG. 6 in order to move the lateral position of pad 62**.

Although the present invention has been described with reference to particular embodiments, it will be apparent to those skilled in the art that variations and modifications can be substituted therefor without departing from the principles and spirit of the invention.

I claim:

1. A leg movement exercise device comprising:

a base adapted to rest on the ground;

track attachment means affixed to said base;

a track rotatably attached to said track attachment means;

a guide member positioned on said track, said guide member adapted to be forwardly and rearwardly movable on said track by said leg movement;

a stirrup adapted to receive one of the user's feet;

stirrup attachment means extending from said guide member and affixed to said stirrup;

an adjustable weight resistance means affixed to said guide member and adapted to provide resistance to rearward movement of said guide member and attached stirrup on said track when pushed rearward by said leg movement;

track angle determination means to adjust the angle of said track from said track attachment means; and upper body support means attached to said base plate generally positioned above said track adapted to support the user's upper body.

2. A leg movement exercise device comprising:

a base adapted to rest on the ground;

a pair of track attachment means affixed to said base;

a pair of tracks each independently rotatably attached respectively to one of said track attachment means;

a first and second stirrup each adapted to receive one of the user's feet;

a first and second guide member each forwardly and rearwardly movably positioned each on one of said tracks;

a first and second stirrup attachment means, each extending respectively from said first and second guide members and each affixed respectively to said first and second stirrup;

a first and second adjustable weight resistance means each affixed respectively to one of said guide members and adapted to provide resistance to rearward movement of each guide member and attached stirrup on each track independently of one another;

track angle determination means to adjust the angles of said tracks from said track attachment means; and upper body support means attached to said base plate generally positioned above said tracks.

3. A leg exercise device comprising:

a base adapted to rest on the ground;

track attachment means affixed to said base;

a track rotatably attached to said track attachment means, said track having a channel defined therein and a slot defined in the top thereof;

a stirrup adapted to receive one of the user's feet;

a guide member adapted to move back and forth within said channel in said track;

a shaft extending from said guide member through said slot in said track and affixed to said stirrup;

an adjustable weight resistance means affixed to said guide member and adapted to provide resistance to rearward movement of said guide member and attached stirrup in said track when pushed rearward by the user's leg;

track angle determination means to adjust the angle of said tracks from said track attachment means; and upper body support means attached to said base plate generally positioned above said tracks adapted to support the user's upper body.

4. A leg exercise device comprising:

a base adapted to rest on the ground;

a pair of track attachment means affixed to said base;

a pair of tracks each rotatably attached respectively to one of said track attachment means, said tracks each having a channel defined therein and a slot defined in the top thereof;

a first and second stirrup each adapted to receive one of the user's feet;

a first and second guide member each adapted to move back and forth within said channel in each of said tracks;

a first and second shaft each extending respectively from said first and second guide members through said slot in each of said tracks and each affixed respectively to said first and second stirrup;

a first and second adjustable weight resistance means each affixed respectively to one of said guide members and adapted to provide resistance to rearward movement of each guide member and attached stirrup in each track independently of one another;

trakc angle determination means to adjust the angles of said tracks from said track attachment means; and upper body support means attached to said base plate generally positioned above said tracks.

5. The device of claim 1, 2, 3 or 4 further including:

stirrup movement means for medial and lateral rotation and forward angular movement of said stirrup during use.

6. The device of claim 1, 2, 3 or 4 wherein said track angle determination means includes:

an aperture defined in each of said track attachment plates, each aperture having a plurality of teeth members arrayed around its inside perimeter; and an adjustment member protruding from the front bottom of said track(s) adapted to engage respectively into said aperture in said track attachment plate in a variety of positions to move said track(s) at angles from 0 to 180 degrees from said base plate.

7. The device of claim 3 or 4 wherein said guide members each include a plurality of wheel members to run within the channel in said track, said guide members each further including a rotational resistance member tiltably mounted within said guide member at the base of said shaft extending to said stirrup.

8. The device of claim 1, 2, 3 or 4 wherein said upper body support means includes:

a balance pad;

means for the vertical and horizontal adjustment of said balance pad; and side wings rotationally mounted on the sides of said balance pad.

9. The device of claim 2 or 4 wherein one track has a fixed stirrup that does not move back and forth on its track while said other track's stirrup does move back and forth.

10. The device of claim 1 or 3 wherein said upper body support means includes:

a balance pad;

means for the vertical and horizontal adjustment of said balance pad;

at least one side wing rotationally mounted on the side of said balance pad; and said device further including a second fixed stirrup attached to said base.

* * * * *